US008053656B1

(12) United States Patent
Chen

(10) Patent No.: US 8,053,656 B1
(45) Date of Patent: Nov. 8, 2011

(54) SINGLE-ARM PEDAL ASSEMBLY FOR PERCUSSION INSTRUMENT

(76) Inventor: Kuo-Chang Chen, Taichung (TW)

( * ) Notice: Subject to any disclaimer, the term of this patent is extended or adjusted under 35 U.S.C. 154(b) by 0 days.

(21) Appl. No.: 12/837,811

(22) Filed: Jul. 16, 2010

(51) Int. Cl.
*G10D 13/02* (2006.01)

(52) U.S. Cl. ..... 84/422.1

(58) Field of Classification Search ..... 84/422.1, 84/422.3, 426, 229
See application file for complete search history.

(56) References Cited

U.S. PATENT DOCUMENTS 6,028,259 A 2/2000 Lombardi et al.
7,795,520 B1 * 9/2010 Chen ..... 84/422.1

* cited by examiner

*Primary Examiner* — Kimberly Lockett
(74) *Attorney, Agent, or Firm* — Muncy, Geissler, Olds & Lowe, PLLC

(57) ABSTRACT

A single-arm pedal assembly of the present invention mainly includes two hammers and two pedals. Each pedal can indirectly drive a hammer to rotate respectively. The single-arm pedal assembly can be reconstituted into two separate pedal assemblies. Both of the two pedal assemblies have one pedal and one hammer. As such, the single-arm pedal assembly can be transformed for particular situations.

7 Claims, 12 Drawing Sheets

SINGLE-ARM PEDAL ASSEMBLY FOR PERCUSSION INSTRUMENT

BACKGROUND OF THE INVENTION

1. Field of the Invention

The present invention relates to a pedal assembly for a percussion instrument.

2. Description of the Prior Art

A typical pedal assembly for a percussion instrument is as disclosed in U.S. Pat. No. 6,028,259. The pedal assembly mainly includes two pedals and two hammers. The two pedals drive the two hammers respectively, so that the hammers can hit a drum. The two hammers are disposed on a single customized frame, which can't be easily separated by an untrained user.

In general, a rookie drum player usually plays a drum with a pedal assembly which has only one pedal and one hammer. As his/her skill is advanced, the player will probably buy another pedal assembly which has two pedals and two hammers. Thus, the former pedal assembly becomes useless, and such pedal assembly is often thrown away.

The present invention is, therefore, arisen to obviate or at least mitigate the above mentioned disadvantages.

SUMMARY OF THE INVENTION

The main object of the present invention is to provide a pedal assembly which includes two pedals and two hammers, and the pedal assembly can be reconstituted into two separate pedal assemblies, which has one pedal and one hammer.

To achieve the above and other objects, a single-arm pedal assembly of the present invention includes two frames, a first main axle, a second main axle, a first linking element, a second linking element, two pedals, two transmission elements, a first resilient means, a second resilient means, a secondary axle, a clamping element, a linkage member and two hammers. Each frame includes a base plate, a supporting arm, and a pedal axle. Each supporting arm extends upward from one of the base plates. Each supporting arm has a distal end which splits into two rack poles. Each rack pole is formed with an axial hole. Each axial hole extends horizontally. The axial poles of each supporting arm are coaxial. Each pedal axle is disposed on one of the base plates. Each pedal axle extends horizontally. The axial holes and the pedal axle of each frame are non-coaxial. Each main axle is received in the axial holes of one of the supporting arms. Each main axle is rotatably disposed on one of the frames. Each main axle is rotatable about its longitudinal direction. The first linking element is disposed on the first main axle. The first linking element and the first main axle are in a rotational operative relationship. The second linking element is disposed on the second main axle. The second linking element and the second main axle are in a rotational operative relationship. Each linking element is adapted for a hammer to install thereon. Each pedal is pivotably disposed about one of the pedal axles. Each transmission element rotatably connects one of the pedals to one of the linking elements. The linking elements rotate during the movement of the transmission elements. The transmission elements move during the sway of the pedals. Each resilient means is for driving one of the pedals to return to its initial position. The secondary axle is removably disposed on the first main axle. The secondary axle includes a shaft. The shaft is rotatable with respect to the first main axle. The clamping element is disposed on the shaft. The clamping element and the shaft are in a rotational operative relationship. The clamping element is adapted for a hammer to install thereon. The linkage member removably connects the second main axle to the shaft, so that the second main axle and the shaft are in a rotational operative relationship. One of the hammers is disposed on the first linking element. The other hammer is removably disposed on the clamping element.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
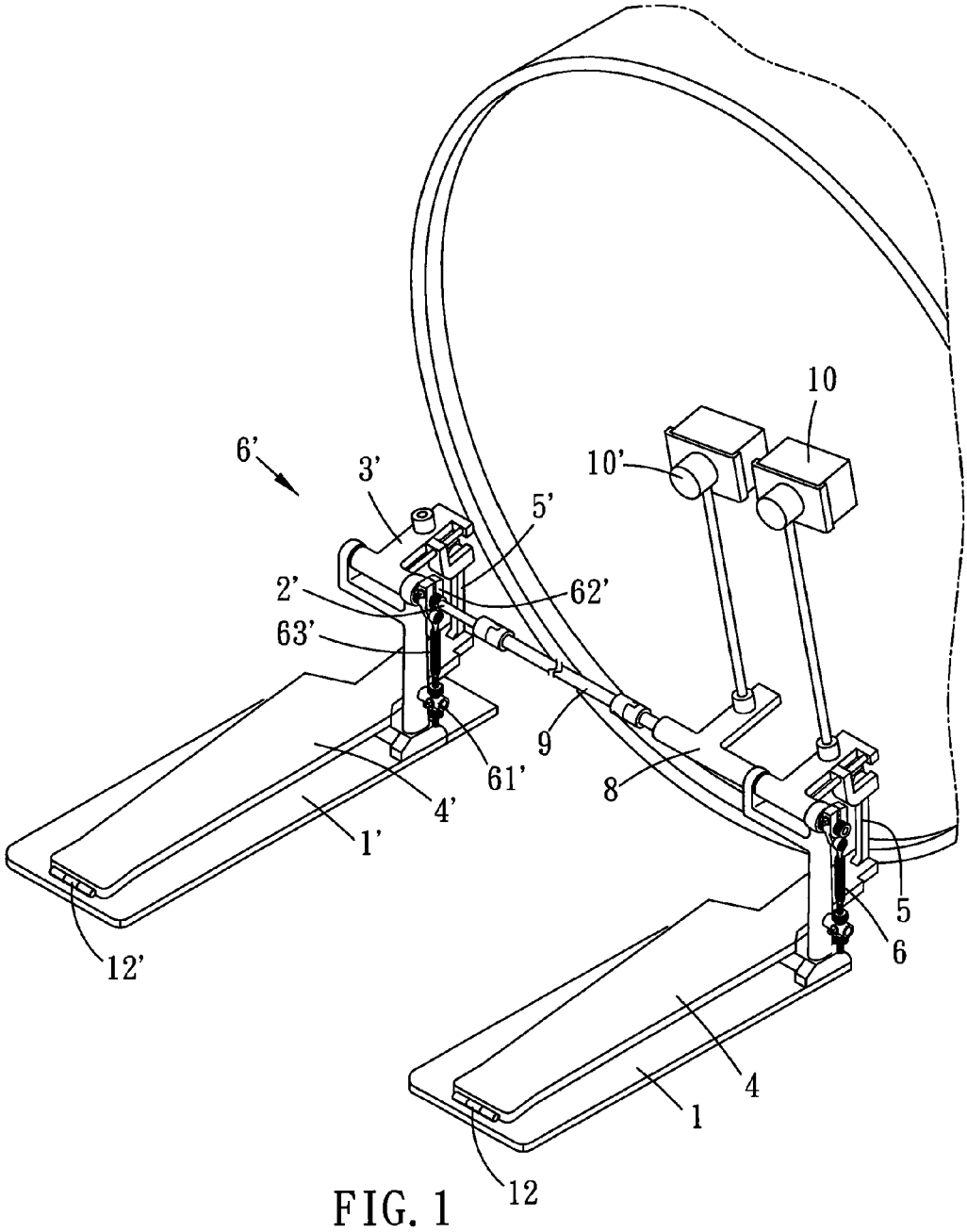
FIG. 1 is a perspective view showing a single-arm pedal assembly of the present invention.
Figure 2:
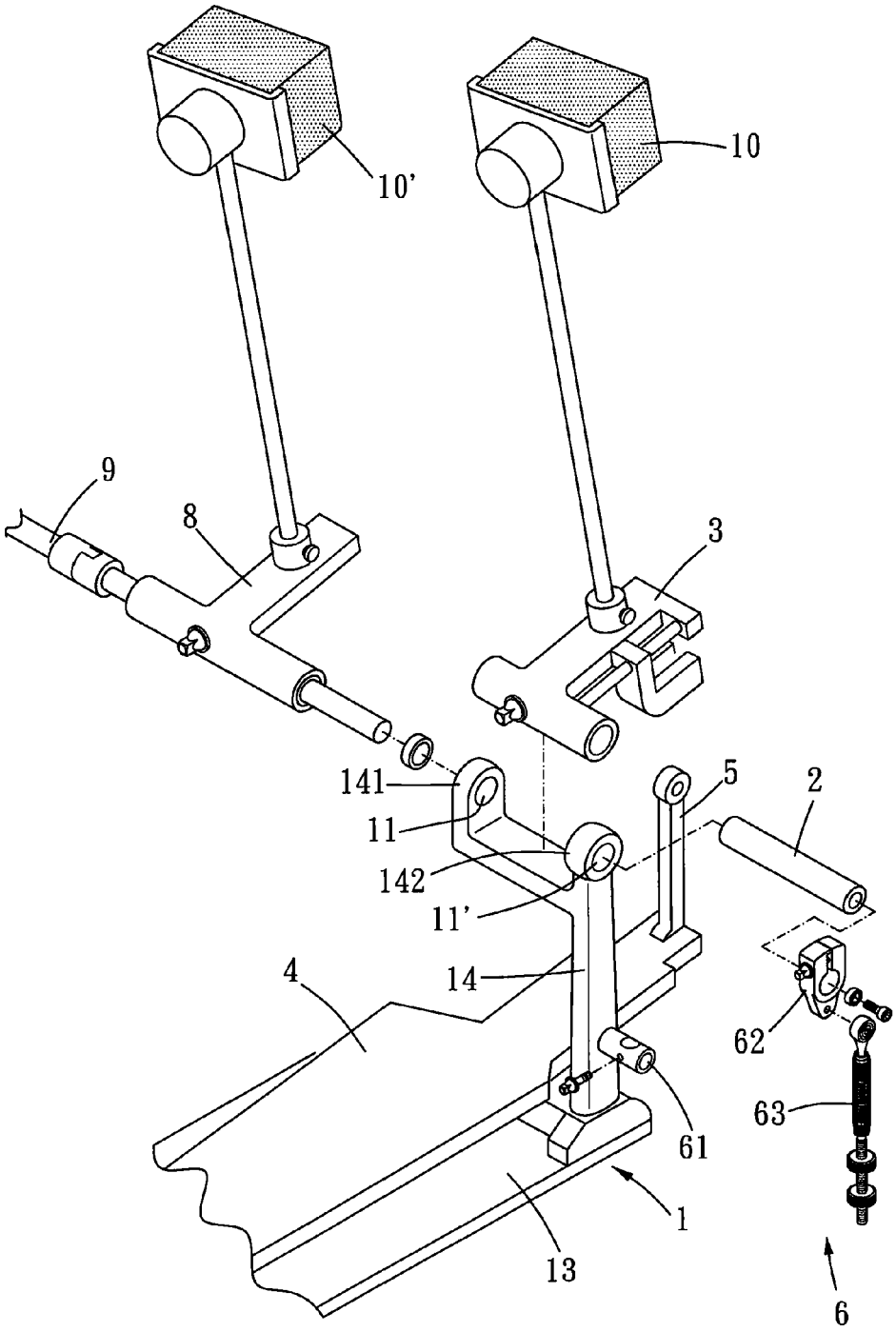
FIG. 2 is a partial breakdown drawing showing a single-arm pedal assembly of the present invention.

Please refer to FIG. 1 to FIG. 4 for a first embodiment of the present invention. The single-arm pedal assembly, which can be horizontally placed on the floor, for a percussion instrument of the present embodiment includes two frames 1, 1', a first main axle 2, a second main axle 2', a first linking element 3, a second linking element 3', two pedals 4, 4', two transmission elements 5, 5', a first resilient means 6, a second resilient means 6', a secondary axle, a clamping element 8, a linkage member 9 and two hammers 10, 10'.

The frame 1 has a base plate 13, a supporting arm 14 and a pedal axle 12. The supporting arm 14 extends upward from the base plate 13. The supporting arm 14 has a distal end which splits into two rack poles 141, 142. Each rack pole 141, 142 is formed with an axial hole 11, 11'. Each axial hole 11, 11' extends horizontally. The two axial holes 11, 11' of the supporting arm 14 are coaxial. The pedal axle 12 is disposed on the base plate 13. The pedal axle 12 extends horizontally. The two axial holes 11, 11' and the pedal axle are non-coaxial. The frame 1' has a similar structure to the frame 1.

Figure 3A:
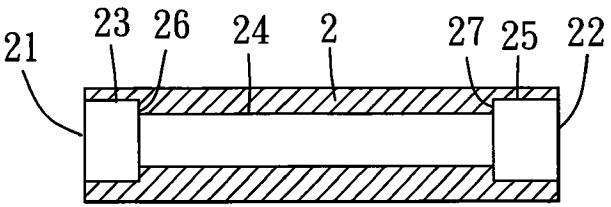
FIG. 3A is a profile showing a first main axle of the present invention.
Figure 3:
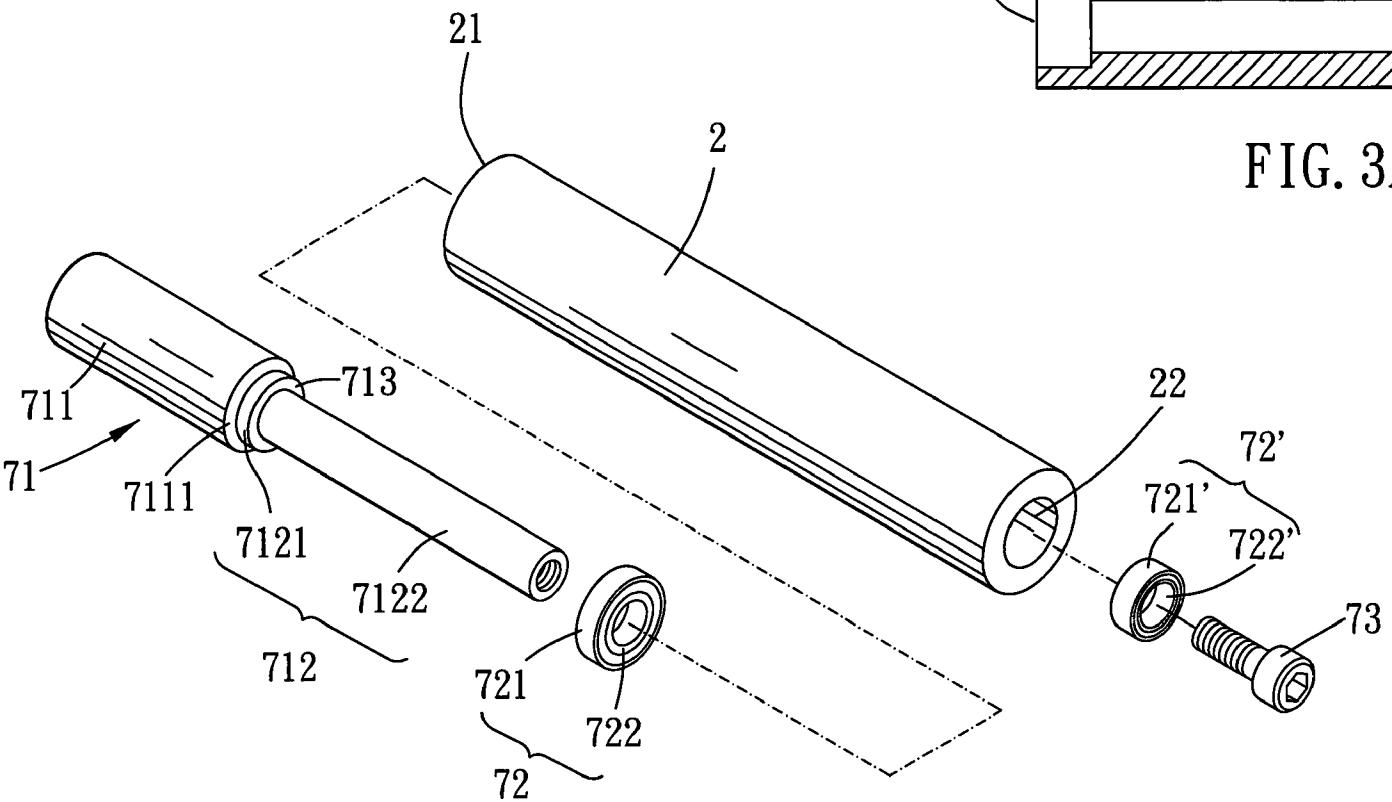
FIG. 3 is a breakdown drawing showing a first embodiment of a connecting mechanism between a first main axle and a secondary axle of the present invention.
Figure 4:
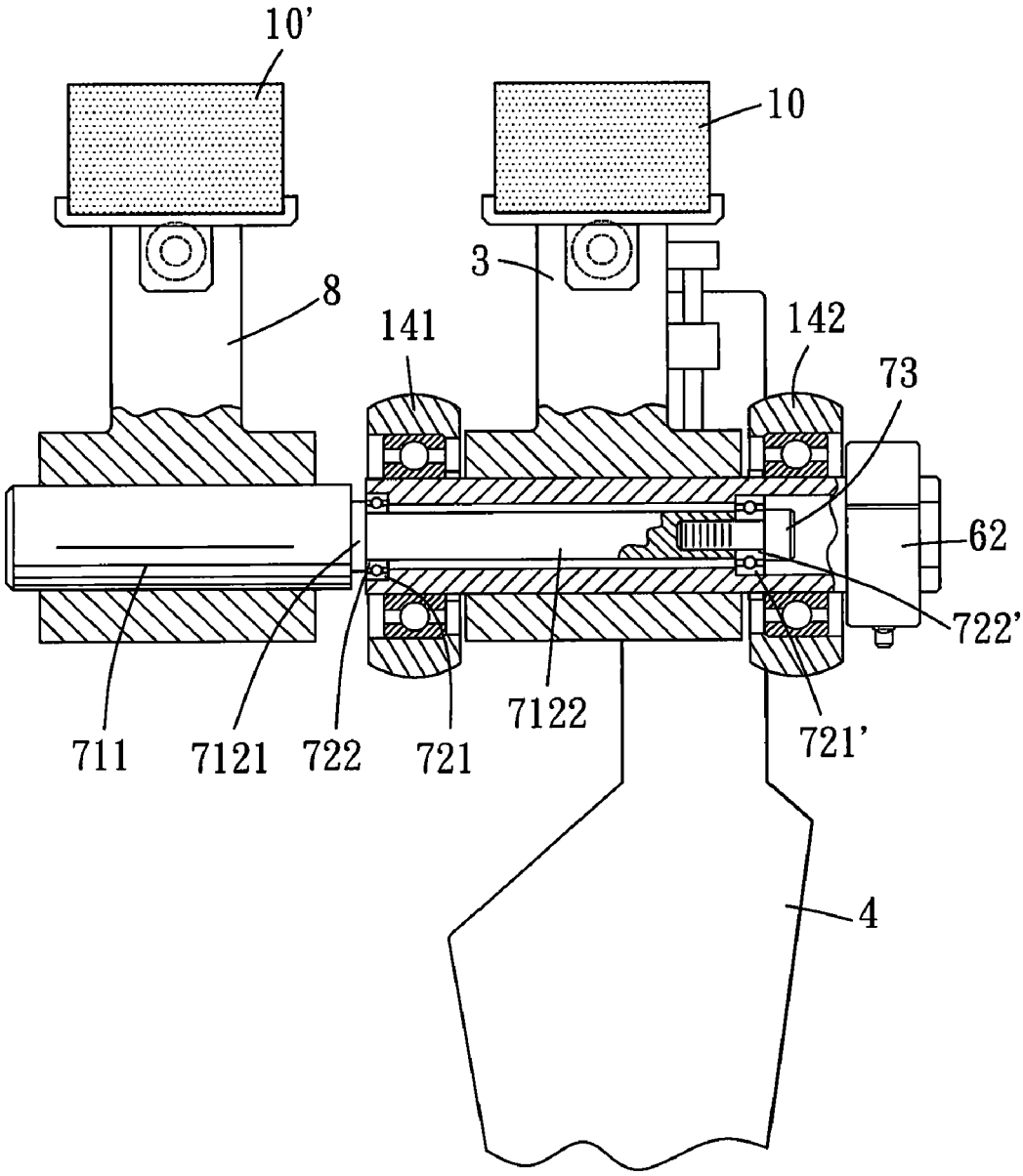
FIG. 4 is a partial profile showing a first embodiment of a single-arm pedal assembly of the present invention.

The first main axle 2 is rotatably received in two axial holes 11, 11' of the supporting arm 14. The second main axle 2' is rotatably disposed on the other flame 1'. Each main axle 2, 2' is rotatable about its longitudinal direction. The first main axle has an inner surface. A penetrating hole is defined in the inner surface so that the first main axle is a tube-shaped axle. Please refer to FIG. 3A. The penetrating hole has a first end 21, a second end 22, a first section 23, a second section 24 and a third section 25. Each section 23, 24, and 25 of the penetrating hole has an inner diameter. The inner diameter of the second section 24 is smaller than those of the other sections. The first main axle 2 forms a first abutting surface 26 between the first section 23 and the second section 24. The first main axle 2 forms a second abutting surface 27 between the second section 24 and the third section 25. The second main axle 2' can be a solid axle or a hollow axle, which is similar to the first main axle 2.

Figure 5:
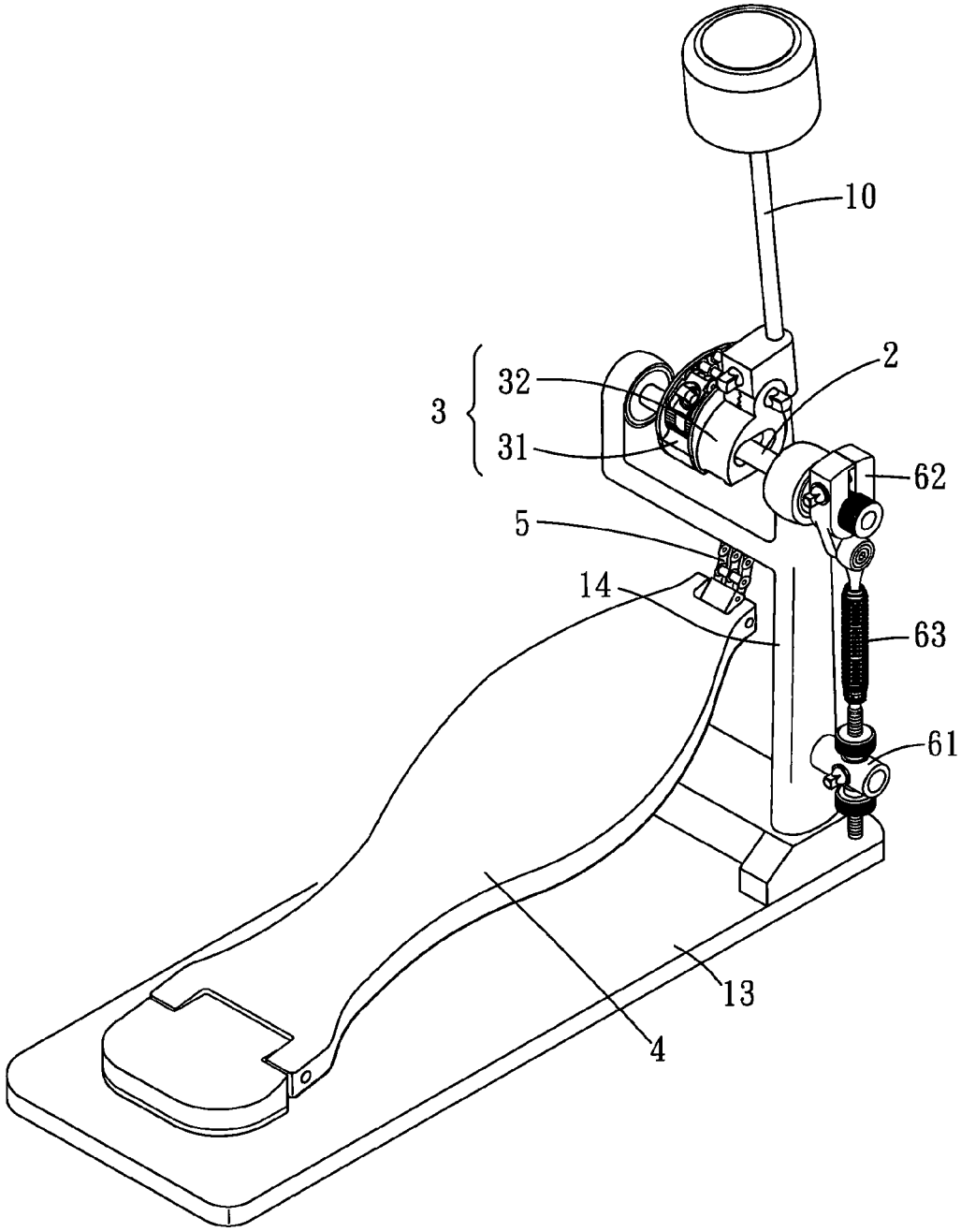
FIG. 5 is a partial perspective view showing a second embodiment of the present invention.

The first linking element 3 is disposed on the first main axle 2 in a rotational operative relationship. The second linking element 3' is disposed on the second main axle 2' in a rotational operative relationship. Each linking element is adapted for a hammer to install thereon. More particularly, each linking element 3, 3' may include a chunk, which is adapted for a hammer. Or, the first linking element 3 may include a sprocket 31 and a chunk 32, as shown in FIG. 5. The first main axle 2 and both the sprocket 31 and the chunk 32 are in a rotational operative relationship.

Each pedal 4, 4' is pivotably disposed about one of the pedal axle 12, 12'. Thus, the pedals 4, 4' can pivot with respect to the frames 1, 1'.

Each transmission element 5, 5' may be a linking bar. Each transmission element 5, 5' rotatably connects one of the pedals 4, 4' to one of the linking elements 3, 3'. The linking elements 3, 3' rotate during the movement of the transmission elements. The transmission elements 5, 5' move during the sway of the pedals 4, 4'. Please refer to FIG. 5. The transmission element 5 may also be a belt or a chain when the first linking element 3 includes the sprocket 31. The sprocket 31 is adapted for the belt or the chain to coil thereon.

Figure 6:
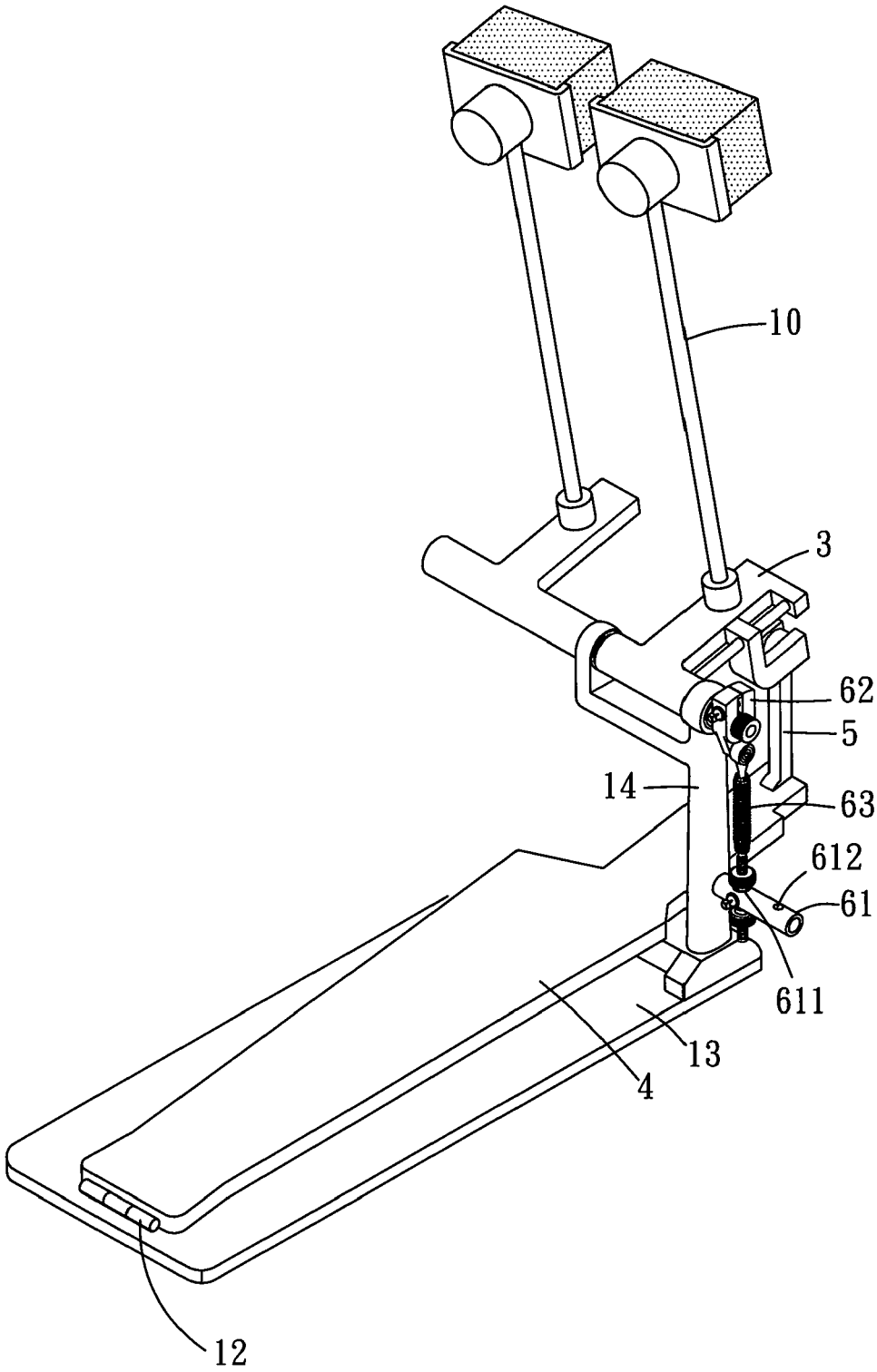
FIG. 6 is a partial perspective view showing a third embodiment of the present invention.

The first resilient means 6 is adapted for driving a pedal 4 to return to an initial position. The second resilient means 6', similar to the first resilient means 6, is adapted for driving the other pedal 4' to return to another initial position. More specifically, the first resilient means includes a fixing piece 61, a swaying piece 62 and a spring element 63. The fixing piece 61 may be fixed on the base plate 13 or the supporting arm 14, so that the fixing piece 61 is firmly disposed on the frame 1. The swaying piece 62 is removably disposed on the first main axle 2 in a rotational operative relationship. The spring element 63 connects the swaying piece 62 to the fixing piece 61. The spring element 63 provides a resilient force to rotate the swaying piece 62, so that the first main axle 2 and the first linking part 3 rotate together. Thus, the pedal 4 moves to an initial position. The second resilient means 6' is provided with a similar structure to the first resilient means 6. For example, the second resilient means 6' may include a fixing piece 61', a swaying piece 62' and a spring element 63'. The fixing piece 61' is firmly disposed on the frame 1'. The swaying piece 62' is removably disposed on the second main axle 2' in a rotational operative relationship. The spring element 63' connects the swaying piece 62' to the fixing piece 61'. The spring element 63' provides another resilient force to rotate the swaying piece 62', so that the second main axle 2' and the second linking part 3' rotate together. Thus, the pedal 4' moves to another initial position. The fixing piece 61 of the first resilient means 6 may further include a main fixing lump 611 and a secondary fixing lump 612, as shown in FIG. 6. Both the main fixing lump 611 and the secondary fixing lump 612 are adapted for a spring element to connect thereon.

The secondary axle is removably disposed on the first main axle 2. The secondary axle includes a shaft 71. The shaft 71 is rotatable with respect to the first main axle 2. More specifically, the secondary axle may include the shaft 71, a first bearing 72, a second bearing 72' and a threaded element 73. The shaft 71 has a working portion 711 and a constructing portion 712. One end of the working portion 711 forms a stepped surface 7111. The constructing portion 712 extends axially from the stepped surface 7111. The constructing portion 712 may includes a bigger diameter section 7121 and a smaller diameter section 7122. The bigger diameter section 7121 connects the smaller diameter section 7122 to the working portion 711. A distal end of the constructing portion 712 is formed with a threaded hole. The shaft 71 has a third abutting surface 713 located between the bigger diameter section 7121 and the smaller diameter section 7122. The first bearing 72 includes an outer ring 721 and an inner ring 722, which is received in the outer ring 721. Several balls may be disposed between the outer ring 721 and the inner ring 722. Or, the outer ring 721 may slidably contact to the inner ring 722. Thus, the outer ring 721 is rotatable with respect to the inner ring 722. The second bearing 72' has a similar structure to the first bearing 72. The second bearing 72' includes an outer ring 721' and an inner ring 722', which is received in the outer ring 721'. The outer ring 721' of the second bearing 72' is rotatable with respect to the inner ring 722' of the second bearing 72'. The constructing portion 712 is received in the penetrating hole from the first end 21. The first bearing 72 is radially disposed between the constructing portion 712 and the first main axle 2. The first bearing 72 is axially disposed between the third abutting surface 713 and the first abutting surface 26. The threaded element 73 mates with the threaded hole of the constructing portion 712 from the second end 22. The second bearing 72' is axially disposed between the second abutting surface 27 and the threaded element 73. Thus, the two bearing 72, 72' is disposed between the shaft 71 and the first main axle 2. In other embodiment of the present invention, the shaft 71 may slidably contact to the first main axle 2 directly.

The clamping element 8 is disposed on the shaft 71 in a rotational operative relationship. The clamping element 8 is adapted for a hammer to install thereon. Wherein, the clamping element 8 may be disposed on the working portion 711.

The linkage member 9 removably connects the second main axle 2' to the shaft 71 in a rotational operative relationship. Thus, the second main axle 2' and the shaft 71 can rotate simultaneously.

One of the two hammers 10 is removably disposed on the first linking element 3, so the hammer 10 and the linking element 3 can rotate together. The other hammer 10' is removably disposed on the clamping element 8. In other possible embodiments of the present invention, the hammer 10 may be firmly disposed on the first linking element 3.

Figure 7:
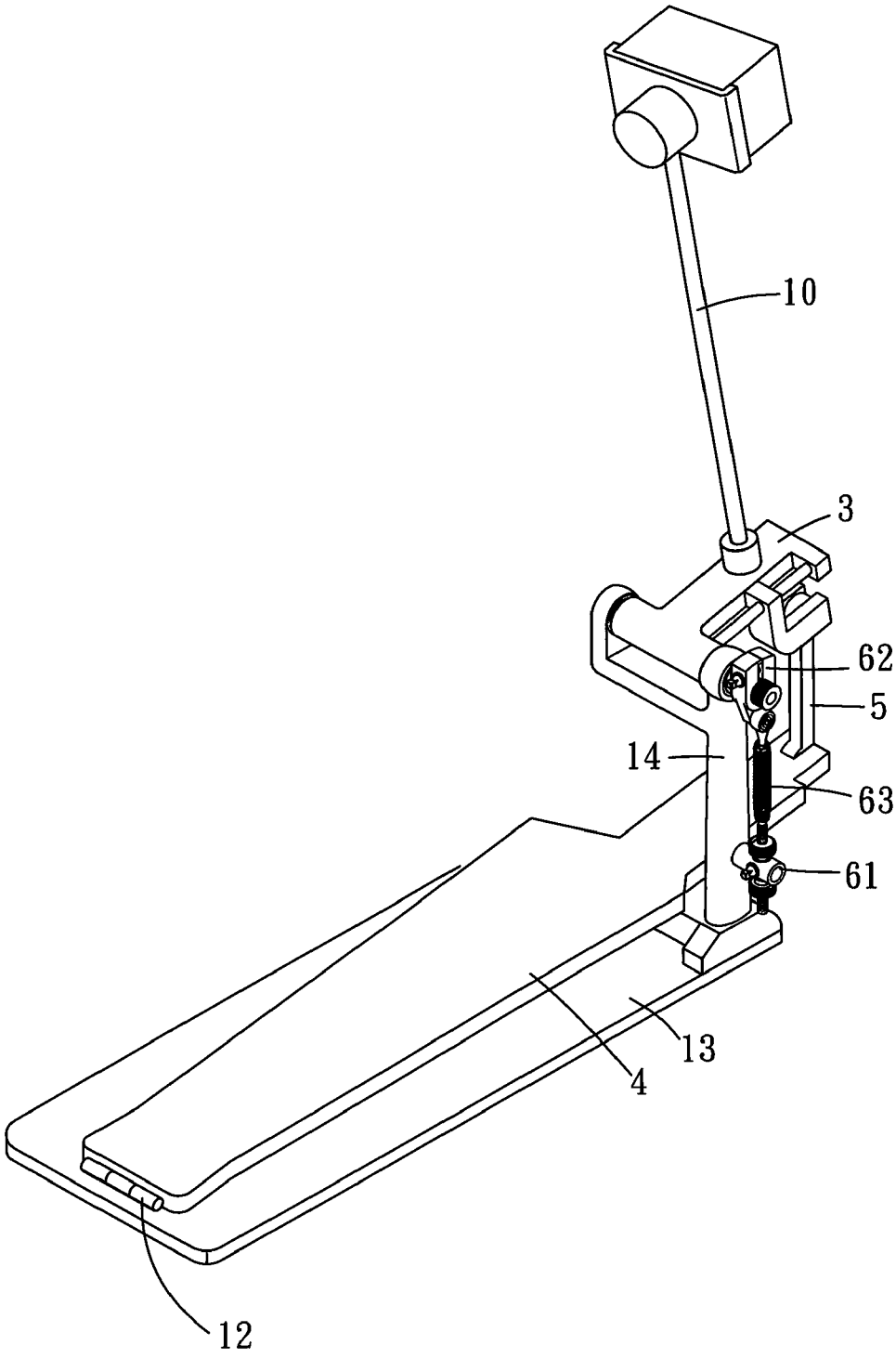
FIG. 7 is a perspective view showing a single-arm pedal assembly of the present invention after it is reconstituted.

Accordingly, the single-arm pedal assembly can be used to percuss a drum, in which the two pedals 4, 4' can drive the two hammers respectively. When users need only one pedal and one hammer, the secondary axle and the linkage member can be removed. Also, the hammer 10' may be repositioned on the second linking element 3'. In the event, the single-arm pedal assembly is reconstituted into two single-hammer pedal assemblies. Each single-hammer pedal assembly has only one pedal and one hammer, as shown in FIG. 7.

Figure 8:
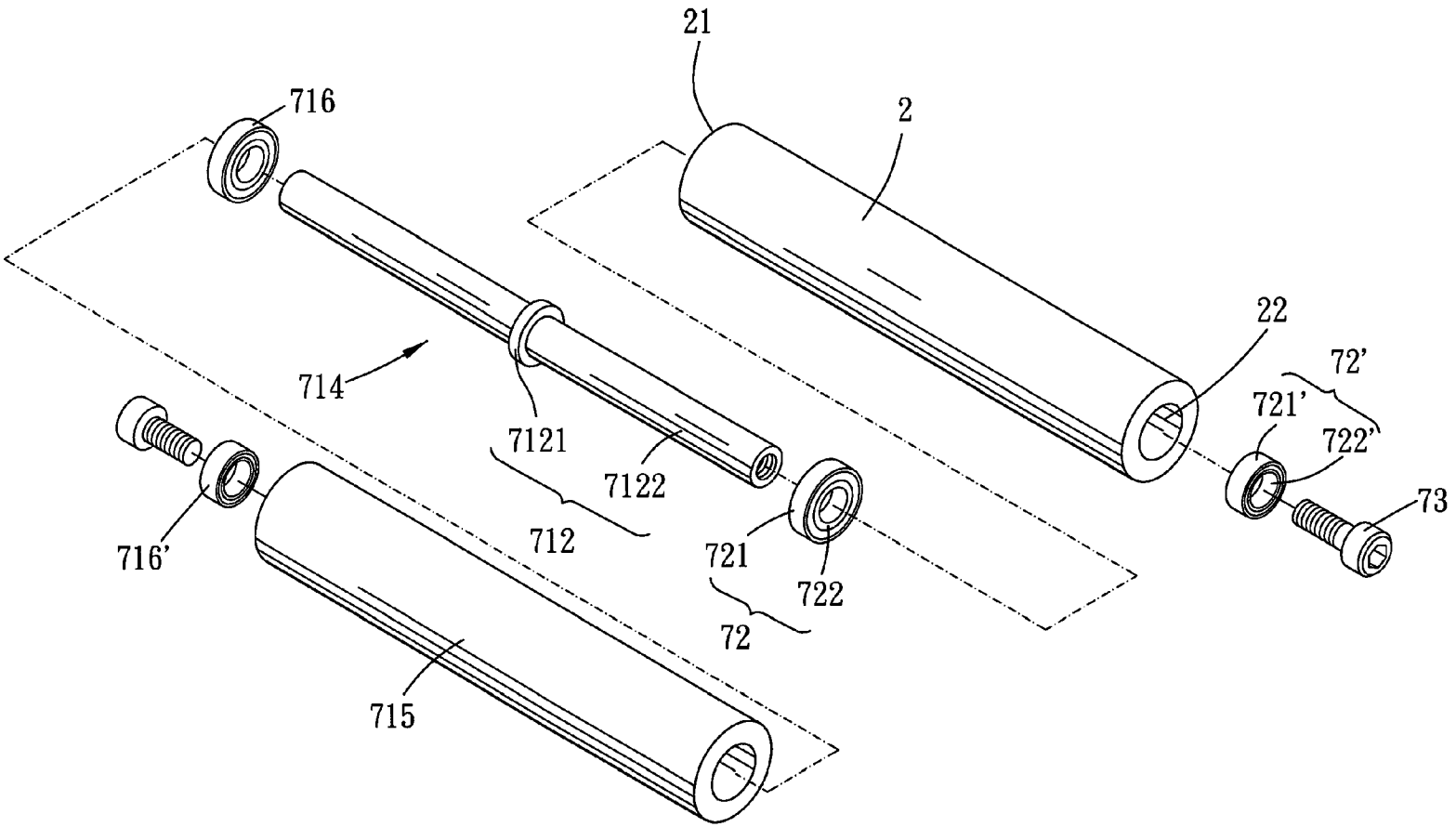
FIG. 8 is a breakdown drawing showing a fourth embodiment of a connecting mechanism between a first main axle and a secondary axle of the present invention.
Figure 9:
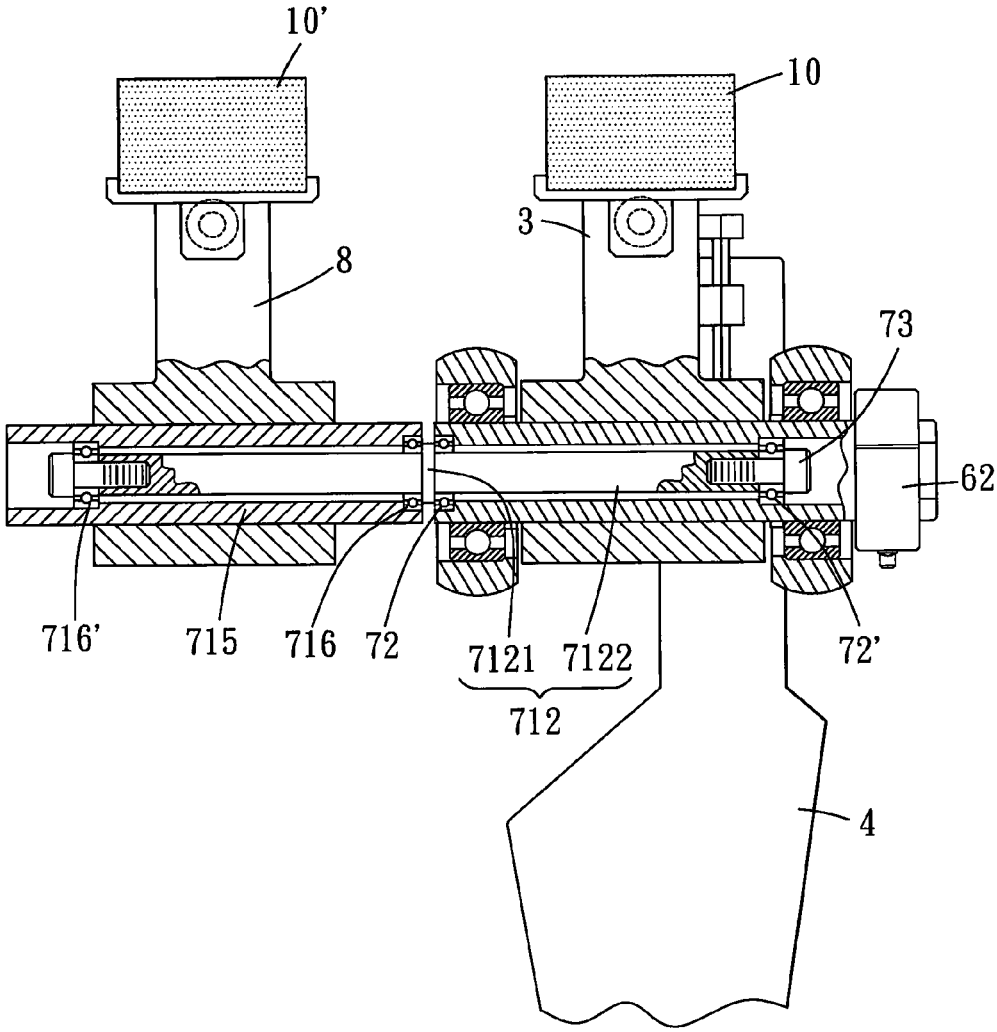
FIG. 9 is a partial profile showing a fourth embodiment of the present invention.

Please refer to FIG. 8 and FIG. 9. In another embodiment of the present invention, the shaft may include a rod 714 and a sleeve 715. The rod 714 has two ends. One end of the rod 714 is received in the sleeve 715. The rod 714 is rotatable with respect to the sleeve 715. The other end of the rod 714 extends axially forming the constructing portion 712. The working portion, which is disposed the clamping element 8 thereon, is formed with the sleeve 715. The rod 714 may connect slidably to the sleeve 715. Or, several bearings 716, 716' may be disposed between the rod 714 and the sleeve 715 so that the rod 714 is rotatable with respect to the sleeve 715.

Figure 10:
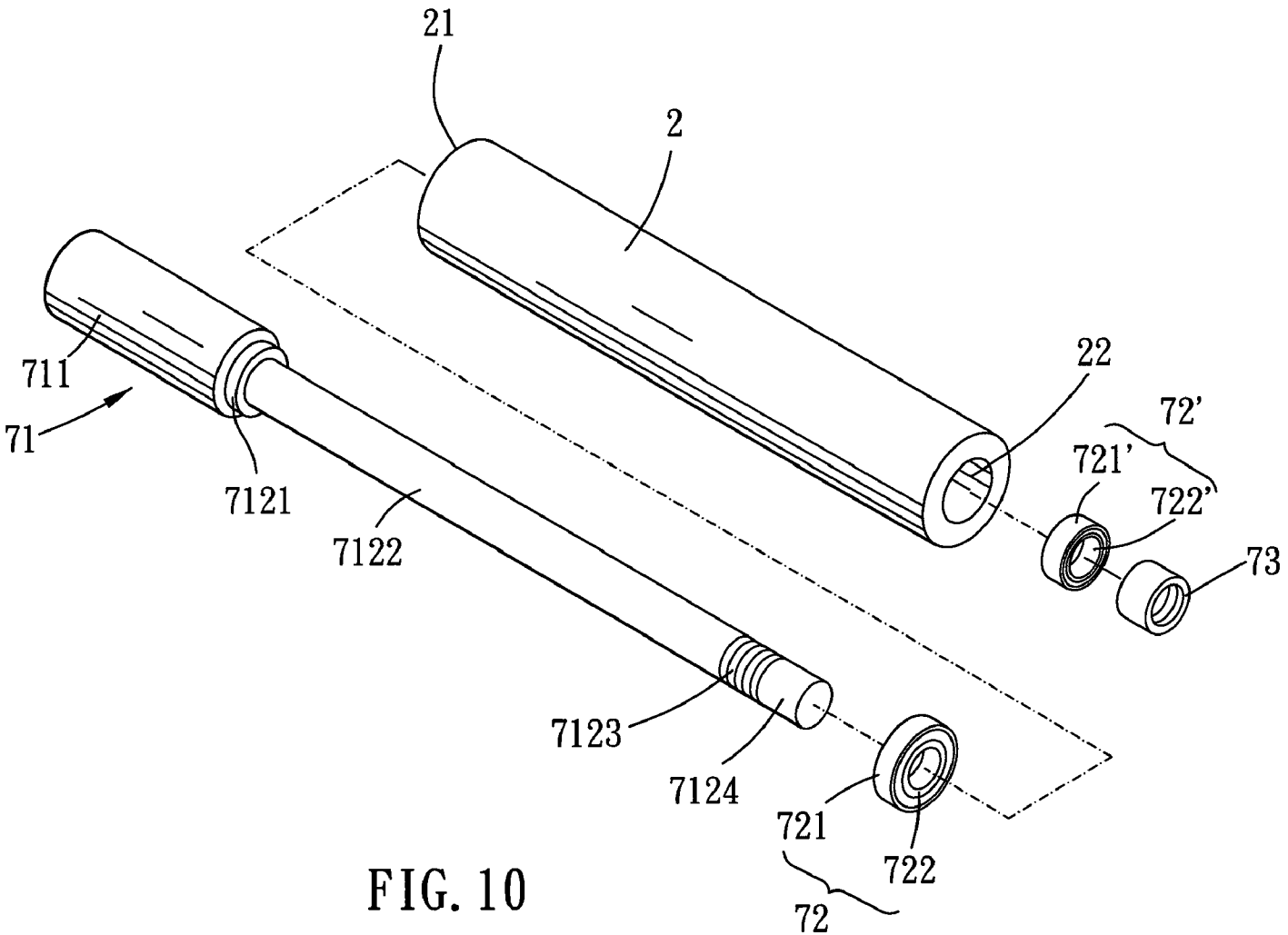
FIG. 10 is a breakdown drawing showing a fifth embodiment of a connecting mechanism between a first main axle and a secondary axle of the present invention.
Figure 11:
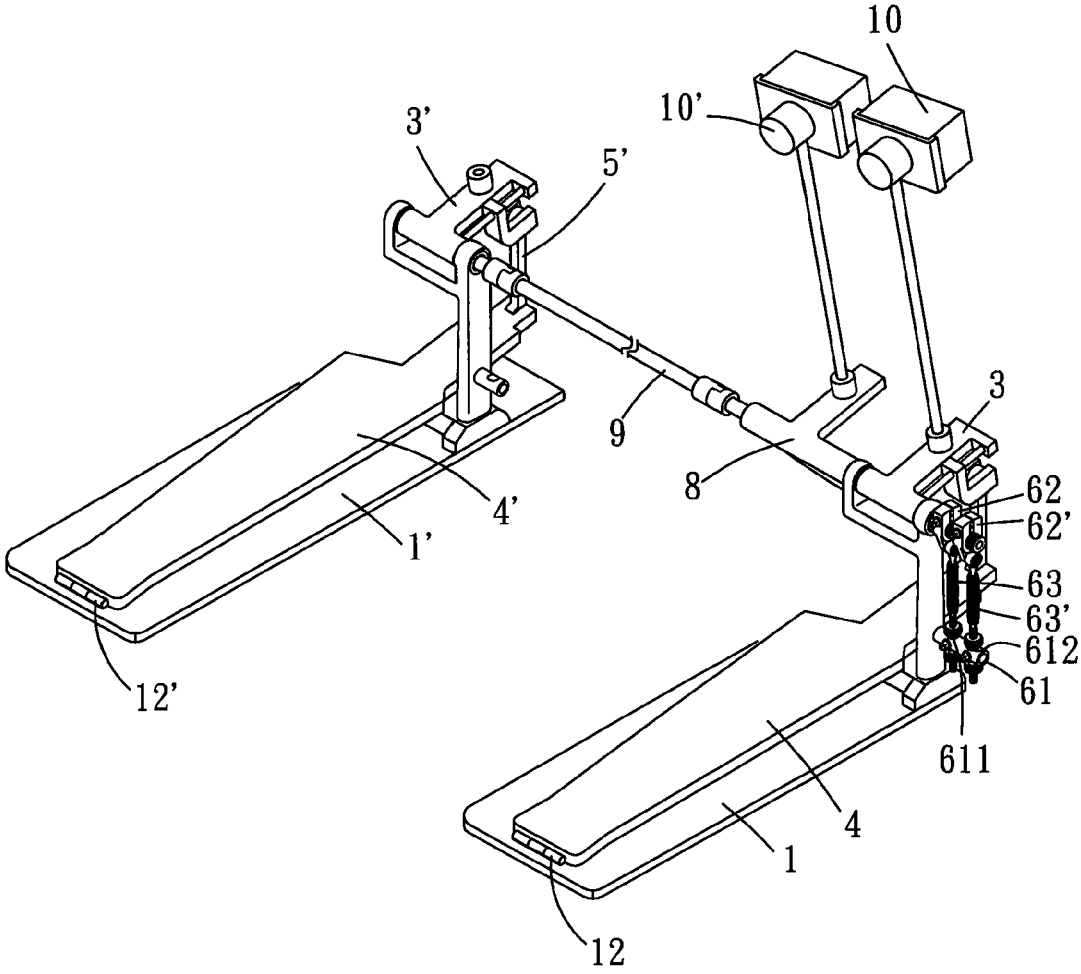
FIG. 11 is a perspective view showing a fifth embodiment of the present invention.
Figure 12:
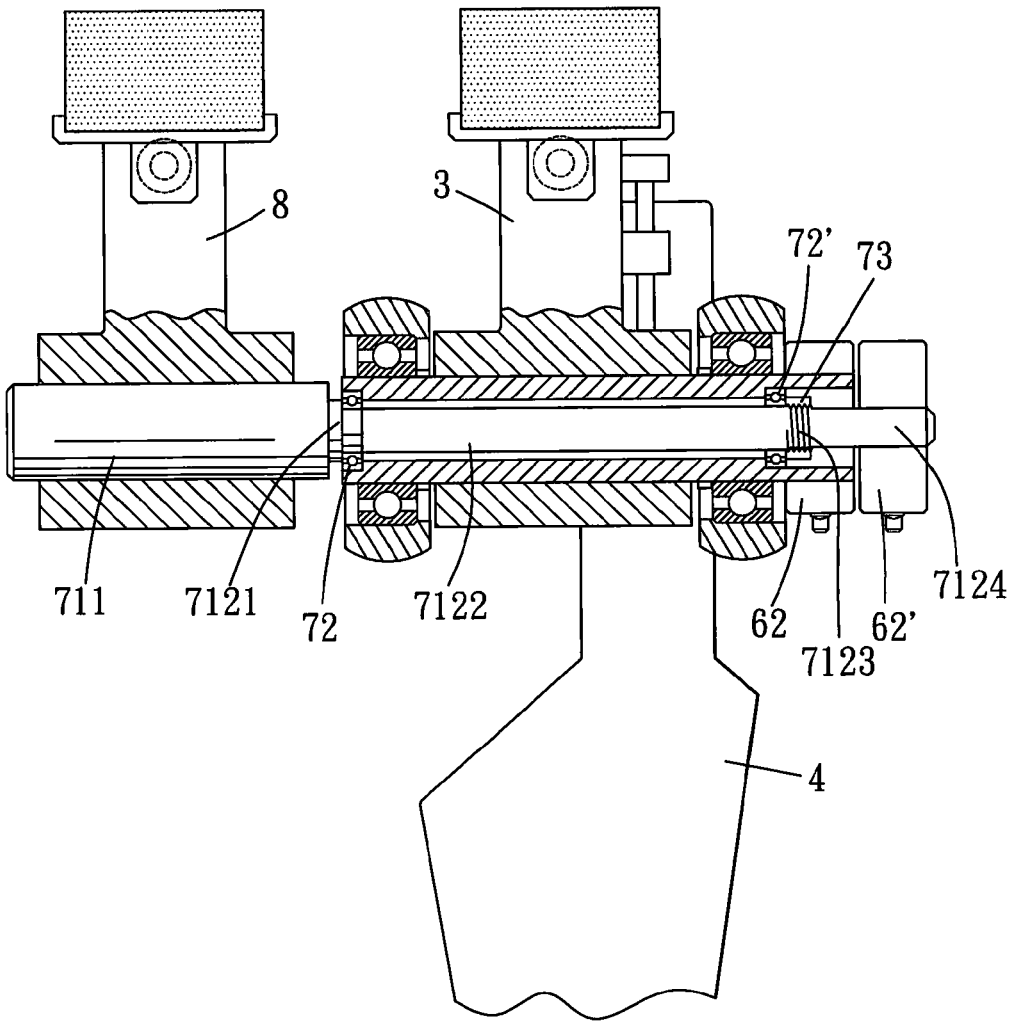
FIG. 12 is a partial profile showing a fifth embodiment of the present invention.

Please refer to FIG. 10 to FIG. 12. In another embodiment of the present invention, the constructing portion 712 may include a bigger diameter section 7121, a smaller diameter section 7122, a screw section 7123 and a stretching section 7124. The bigger diameter section 7121 connects the smaller diameter section 7122 to the working portion 711. The screw section 7123 connects the stretching section 7124 to the smaller diameter section 7122. The smaller diameter section 7122 is received in the second bearing 72. The threaded element 73 mates with the screw section 7123. The stretching section 7124 passes through the second end 22 of the penetrating hole. As a result, the swaying piece 62' of the second resilient means may be repositioned on the stretching section 7124. The spring element 63' of the second resilient means can connect the swaying piece of the second resilient means to the secondary lump of the fixing piece 61 of the first resilient means. The spring element 63' of the second resilient means can make the swaying piece 62' of the second resilient means and the shaft 71 rotate.

What is claimed is:

1. A single-arm pedal assembly for a percussion instrument, the single-arm pedal assembly can be horizontally placed on the floor, the single-arm pedal assembly comprising:

two frames, each frame having a base plate, a supporting arm and a pedal axle, each supporting arm extending upward from one of the base plates, each supporting arm having a distal end which splits into two rack poles, each rack pole being formed with an axial hole, each axial hole extending horizontally, the axial holes of each supporting arm being coaxial, each pedal axle being disposed on one of the base plates, each pedal axle extending horizontally, the axial holes and the pedal axle of each frame being non-coaxial;

a first main axle and a second main axle, each main axle being received in the axial holes of one of the supporting arms, each main axle being rotatably disposed on one of the frames, each main axle being rotatable about its longitudinal direction;

a first linking element and a second linking element, the first linking element being disposed on the first main axle, the first linking element and the first main axle being in a rotational operative relationship, the second linking element being disposed on the second main axle, the second linking element and the second main axle being in a rotational operative relationship, each linking element being adapted for a hammer to install thereon;

two pedals, each pedal being pivotably disposed about one of said pedal axles;

two transmission elements, each transmission element rotatably connecting one of said pedals to one of said linking elements, the linking elements rotating during the movement of the transmission elements, the transmission elements moving during the sway of the pedals;

a first resilient means for driving one of the pedals to return to an initial position;

a second resilient means for driving the other pedal to return to another initial position;

a secondary axle, removably disposed on the first main axle, the secondary axle comprising a shaft, the shaft being rotatable with respect to the first main axle;

a clamping element, disposed on the shaft in a rotational operative relationship, the clamping element being adapted for a hammer to install thereon;

a linkage member, removably disposed between the second main axle and the shaft in a rotational operative relationship;

two hammers, one of the hammers being installed on the first linking element, the other hammer being removably installed on the clamping element.

2. The single-arm pedal assembly of claim 1, wherein the first main axle has an inner surface, a penetrating hole is defined in the inner surface, the penetrating hole has a first end and a second end, the shaft has a working portion and a constructing portion, the working portion has a stepped surface, the constructing portion extends axially from the stepped surface, a distal end of the constructing portion is formed with a threaded hole, the constructing portion is received in the penetrating hole from the first end, the constructing portion is rotatable with respect to the first main axle; the secondary axle further comprises a threaded element, the threaded element mates with the threaded hole from the second end, the first main axle is located between the threaded element and the stepped surface.

3. The single-arm pedal assembly of claim 2, wherein the penetrating hole has a first section, a second section and a third section, each section has an inner diameter, the inner diameter of the second section is smaller than those of the other sections, the first main axle has a first abutting surface and a second abutting surface, the first abutting surface is located between the first section and the second section, the second abutting surface is located between the second section and the third section; the secondary axle further comprises a first bearing and a second bearing, each bearing has an inner ring and an outer ring, each outer ring rotatably surrounds its corresponding inner ring, the first bearing is radially located between the constructing portion and the first main axle, the first bearing is axially located between the first abutting surface and the stepped surface, the second bearing is axially located between the second abutting surface and the threaded element.

4. The single-arm pedal assembly of claim 3, wherein the constructing portion is formed with a bigger diameter section and a smaller diameter section, the bigger diameter section connects the smaller diameter section to the working portion, the shaft is formed with a third abutting surface between the bigger diameter section and the smaller diameter section, the first bearing is axially located between the first abutting surface and the third abutting surface.

5. The single-arm pedal assembly of claim 2, wherein the shaft comprises a rod and a sleeve, the working portion is defined by the sleeve, the rod has two ends, the sleeve covers one end of the rod, the rod is rotatable with respect to the sleeve, the constructing portion is defined on the other end of the rod.

6. The single-arm pedal assembly of claim 1, wherein each resilient means comprises a fixing piece, a swaying piece and a spring element, each fixing piece is firmly disposed on one of the frames, the swaying piece of the first resilient means is disposed on the first main axle in a rotational operative relationship, the spring element of the first resilient means connects the swaying piece of the first resilient means to the fixing piece of the first resilient means, the swaying piece of the second resilient means is disposed removably on the second main axle in a rotational operative relationship, the spring element of the second resilient means connects the swaying piece of the second resilient means to the fixing piece of the second resilient means, each spring element provides a resilient force to rotate its corresponding swaying piece, so that the resilient forces move the pedals to the initial places.

7. The single-arm pedal assembly of claim 6, wherein the first main axle has an inner surface, a penetrating hole is defined in the inner surface, the penetrating hole has a first end and a second end, the shaft has a working portion and a constructing portion, the constructing portion is formed with a bigger diameter section, a smaller diameter section, a screw section and a stretching section, the bigger diameter section connects the smaller diameter section to the working portion, the screw section connects the stretching section to the smaller diameter section, the constructing portion is received in the penetrating hole from the first end, the stretching section passes through the penetrating hole; the secondary axle further comprises a threaded element, the threaded element mates with the screw section from the second end, the smaller section is rotatable with respect to the first main axle; the fixing piece of the first resilient means comprises a main fixing lump and a secondary fixing lump, both the main fixing lump and the secondary fixing lump are adapted for a spring element to connect thereon.

* * * * *